United States Patent [19]

Zinno et al.

[11] 4,229,034

[45] Oct. 21, 1980

[54] DEVICE FOR THE ROTATION OF CONTAINERS

[75] Inventors: Oscar Zinno, Genoa-Quinto; Antonio Tocchella, Genoa-Pegli, both of Italy

[73] Assignee: Costruzioni Meccaniche Industriali Genovesi C.M.I. S.p.A., Genoa-Fegino, Italy

[21] Appl. No.: 950,303

[22] Filed: Oct. 11, 1978

[30] Foreign Application Priority Data

Nov. 23, 1977 [IT] Italy ..... 12850 A/77

[51] Int. Cl.[3] ..... B66C 1/62

[52] U.S. Cl. ..... 294/81 SF; 294/67 R

[58] Field of Search ..... 294/865 F, 86 R, 67 R, 294/67 A, 67 AA, 67 AB, 67 B, 67 BB, 67 D, 67 DC, 69 DC; 212/11, 13, 14, 41, 47, 83; 414/620, 621

[56] References Cited

U.S. PATENT DOCUMENTS

| | | | |
|---|---|---|---|
| 3,567,040 | 3/1971 | Thomson | 212/41 |
| 3,598,440 | 8/1971 | Ramsden et al. | 294/67 R |

*Primary Examiner*—James B. Marbert

*Attorney, Agent, or Firm*—Robert E. Burns; Emmanuel J. Lobato; Bruce L. Adams

[57] ABSTRACT

In container handling apparatus, a device for rotating a container comprises a central body and four orientable arms which are pivotally mounted on the central body and at their outer ends have pulleys which receive support ropes coming down from an overhead carriage. The pulleys are pivotally mounted with a parallelogram linkage so that they stay parallel to themselves as the arms swing fron one position to another according to the orientation of the container. A lower catching means is rotatably supported by the central body.

6 Claims, 10 Drawing Figures

DEVICE FOR THE ROTATION OF CONTAINERS

BACKGROUND OF THE INVENTION

The known means for lifting and carrying containers are divided roughly in two kinds, at least as for the possibility of rotating the container during transportation around a vertical axis.

The first kind comprises that a container is lifted from a store and, remaining parallel to itself, is carried to another place, for instance from the pier to the ship, from a point of the pier to another, or from a point of the ship to another.

The second type comprises on the contrary that a container may rotate about a vertical axis, for instance for better utilizing the available space on a pier or a ship.

Most of the known devices for handling containers are of the first kind, as those of the second kind, allowing the container to rotate, are much more complicated and expensive than the first ones.

In fact, the known devices of the second kind comprise a carriage sliding on the main bar of the container handling crane and a turnable platform resting on said carriage or hanging below thereof. Said platform on its turn supports, through a suitable system of cables known per se, a crossbar catching the container, called a spreader.

As said platform is turnable about a vertical axis, also the container and relevant spreader will be turnable about said vertical axis.

Said platform is provided with winding drums for the cables supporting said spreader, and said drums need for their movement engines arranged on said platform.

Therefore, the known devices for rotating containers are to be provided with a rotating platform of the kind above-mentioned, said platform being very heavy with respect to the container and spreader with the consequence that said devices are much more expensive than those not allowing said rotation.

Besides, the presence of said rotating platform on which are arranged the winding drums for the cables supporting the container, and the relevant actuating engines, makes completely different the two kinds of devices, in fact the first kind cannot be transformed into a device of the second kind.

OBJECTS OF THE INVENTION

In view of the foregoing the invention aims at removing the above drawbacks obtaining, even by modifying a device of the first kind, a device allowing to obtain in a simple and economic way the rotation of containers during their handling.

SUMMARY OF THE INVENTION

According to the invention, with respect to the known devices, the platform turning on said carriage, and the lifting ropes extending from stationary points of the carriage are no longer necessary for the rotation apparatus which is the object of the invention.

The apparatus claimed, called from now on the central body of the claimed device, supports the container below in such a way so as to allow its rotation in a conventional spreader through which the containers are caught and lifted.

It is important to note that said central body of the device claimed has as its main function to rotate the container, performing at the same time and automatically, through gears and levers, a second and third function. The idea of the invention resides in the possibility of performing said three simultaneous functions.

The first function consists of the possibility of rotating a container for 90°, 180° or 270° to a new position, in either direction, without any limit in the total angle.

The second function consists of maintaining the final volume, that is after the rotation of the central body claimed, within the volume of a common container with a suitable play; in the contrary case it would not be possible to place a container between two stacks of adjacent containers or place a container in the cells provided with vertical guides normally provided in container ships.

The third function consists of that said central body avoids any inclination of the container during its rotation from a starting to a final position, after a rotation for any angle (n 90°), where (n) is a whole number. In fact, it is known that the barycenter of the container very seldom concides with the geometrical center of the container, owing to the difference of the loads stored.

For providing said three functions, the apparatus according to the invention consists of the following three main parts:

(a) four orientable arms each carrying at their ends an idling pulley for the supporting ropes carried by the carriage above;

(b) the very central body on which are hinged said four orientable arms at the four corners of a square whose center coincides with the barycenter of said body; said central body further carries the gears and levers actuating said arms, as well as the relevant engines;

(c) a lower frame rotating with respect to said central body through a large diameter ball bearing, and carrying at its four ends the hand actuated twist locks connecting said apparatus to the spreader, that is to the cross-bar supporting the container.

The invention further provides orienting means for said pulleys which, during the rotation of said arms, remain parallel to themselves and thus to the upper support pulleys arranged on the carriage sliding on the main bar.

Besides, during the container rotation, said orientable arms carrying the support supp eys move in such a way that at the intermediate positions of the container longitudinal axis, between a position aligned to the resting plane of said pulleys and a position perpendicular to said plane, said container longitudinal axis is always substantially aligned to two of said orientable four arms.

In this way any danger of inclination of the container due to failed uniformity of the load is avoided.

BRIEF DESCRIPTION OF THE DRAWINGS

In order that the invention may be clearly understood, it will now be described, by way of example, with reference to the accompanying drawings, wherein.

DESCRIPTION OF A PREFERRED EMBODIMENT

A central body 10 is carried by a sliding carriage, not shown, of a crane or the like through metal ropes arranged on four pulleys 11,12,13,14 provided at the ends of four arms 15,16,17,18 rotating with respect to said central body 10 about vertical axes.

Figure 1:
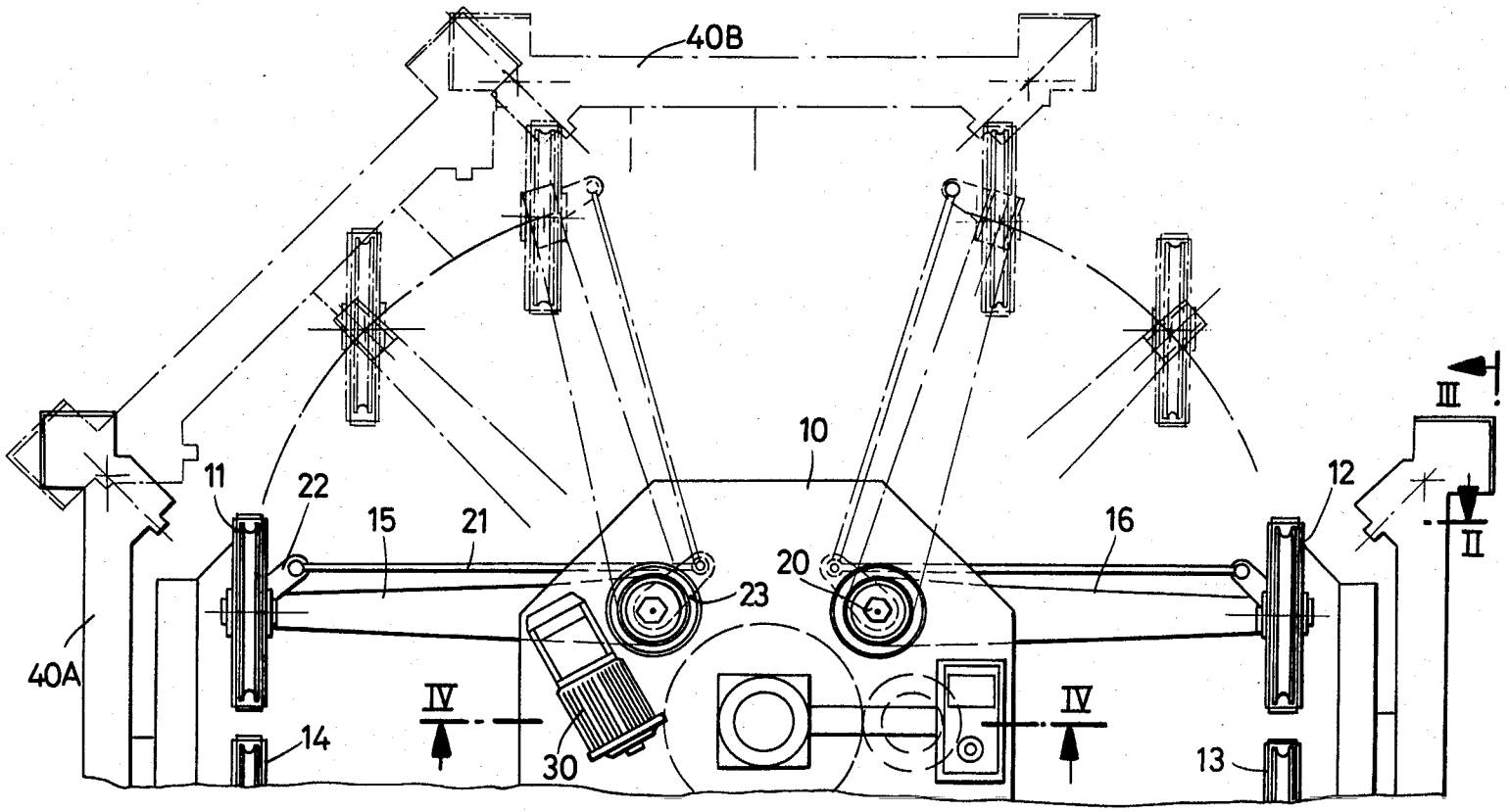
FIG. 1 is a plan view of the device according to the invention.
Figure 2:
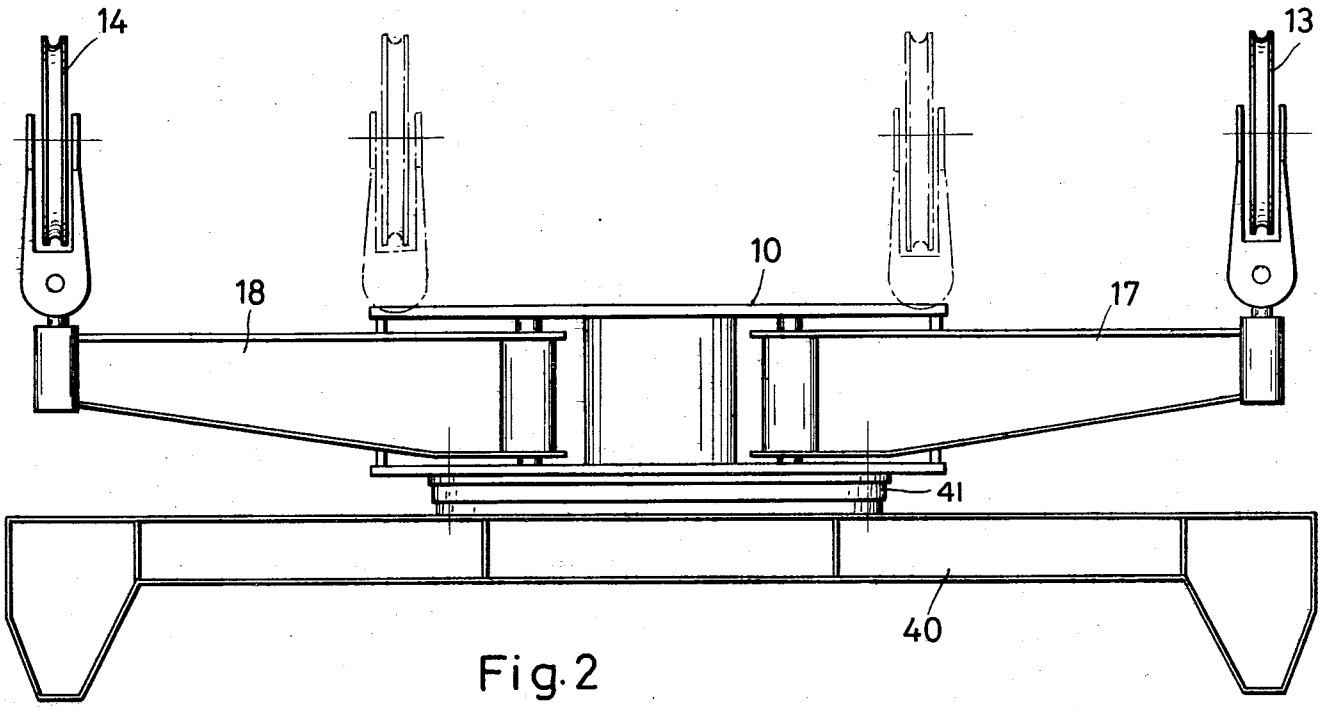
FIG. 2 is a side view along a line II—II of FIG. 1.
Figure 3:
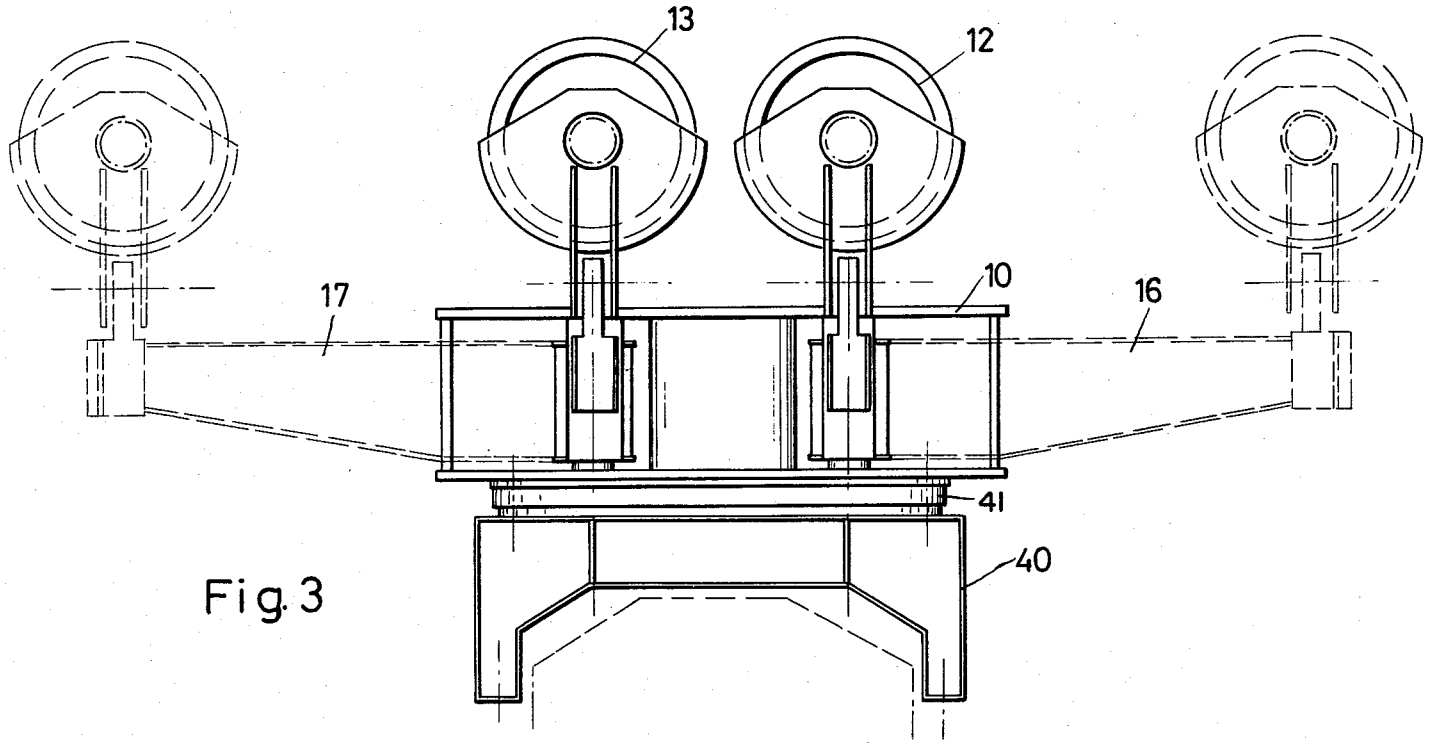
FIG. 3 is a side view along a line III—III of FIG. 1.

Said arms 15 to 18 are each turnable, for an arc of about 90°, between two end positions 15A–18A to 15B–18B shown with a continuous line and dotted line respectively in FIG. 1. FIG. 1 further shown with a dashed line an intermediate position 15G–18G.

Vertical arms 20, supporting said arms 15 to 18, are turnable simultaneously and two by two in opposed directions so that each of them, passing by from one end position to the other, moves away from a contiguous arm and near the other contiguous arms on the other side.

Figure 5:
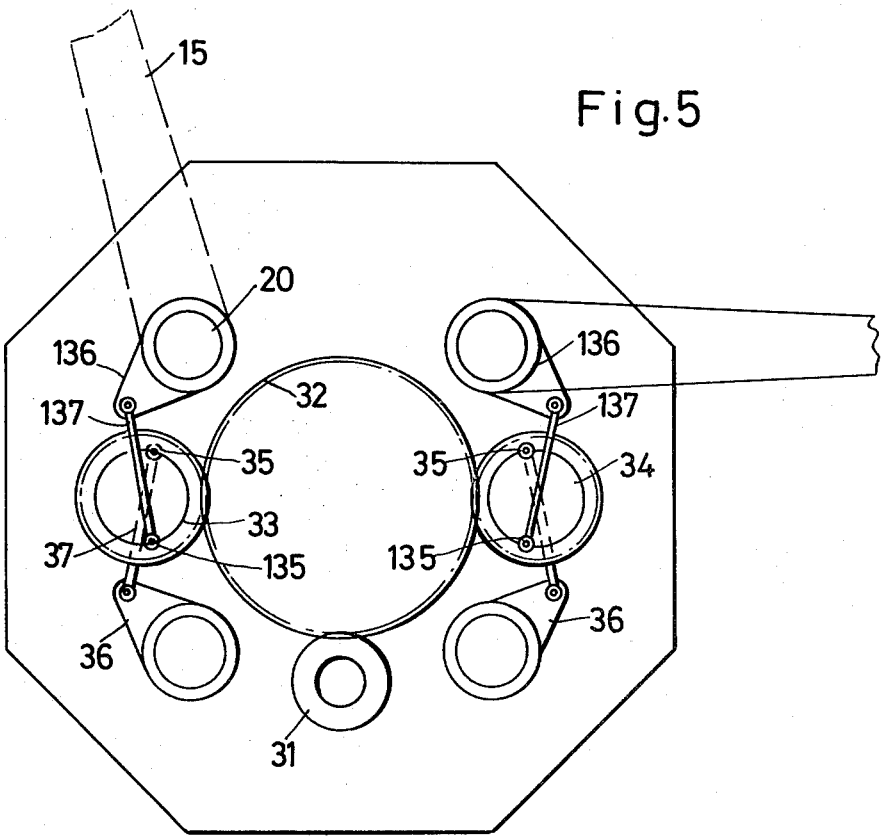
FIG. 5 is a horizontal section along a line V—V of FIG. 4.

Any suitable gear may be used for obtaining such a movement and a possible embodiment thereof is shown in FIG. 5.

During the arms rotation between said end positions, said pulleys 11 to 14 remain parallel to themselves and the upper pulleys, not shown, supported by the carriage sliding on said crane.

According to the invention, the constant parallelism of pulleys 11 to 14 with respect to a fixed direction is obtained, in the embodiment shown, through an articulated parallelogram formed by rods 21 articulated at their ends to arms 22,23 oriented in a stationary way with respect to the corresponding pulley 11 to 14 on one side, and to the corresponding shaft 20 on the other side.

In such a way, when arms 15 to 18 rotate between their two end positions, said pulleys 11 to 14 remain parallel to themselves and thus also to the upper pulleys, not shown, supported in known manner by a carriage movable only on a horizontal plane of the crane or the like.

An engine 30 is mounted on said central body 10, said engine 30 is suitable to cause the rotation of the lower catching frame 40, turnably supported around a vertical axis below said central body 10, by means of a known bearing 41. In its turn said lower frame catches the supporting bar for the container, commonly called spreader.

The transmission of the rotation motion from engine 30 to said lower catching frame for the container may be embodied in any suitable manner, e.g. by rotating means usually called twist locks.

According to a particular embodiment of the invention, said engine 30 provides simultaneously also the angular movement to said arms 15 to 18, as it will be described with particular reference to FIGS. 4 and 5.

For simplicity sake, in FIG. 1 said lower catching frame 40 is shown only at its ends.

With particular reference to FIGS. 1 and 6 to 10, the rotation of said lower catching frame 40 and thus of the spreader and container occurs in the way described herebelow.

With said arms 15 to 18 in their position 15A–18A, said lower catching frame, together with said central body 10, are lowered just above a container not shown, whose volume however may be seen in FIG. 1 through the angles of the catching bar which is now in its position 40A.

The lowering of the group formed by said central body 10, lower catching frame 40 and spreader just above the container to be caught, is possible even when said container is placed between two stacks of adjacent containers, as in the position 15A–18A said arms 15 to 18 are comprised in the plan volume of the contrainer.

When the container is caught, the whole is lifted and then, if desired, the container may be rotated, e.g. for 90° rightwards together with said lower frame 40 and said spreader to position 40B. Said lower catching frame is rotated by means of said engine 30, through suitable gearings, thanks to said bearing 41. During the 90° rotation of said lower frame 40 to position 40B, said arms 15 to 18 rotate for about 90° to position 15B–18B; therefore, while in position 15A–18A arms 15 and 16 were aligned on one side and arms 17 and 18 on the other side, in the new position 15B–18B arms 15 and 18 are aligned to each other on one side and arms 16 and 17 on the other side.

In this new position 15B–18B said arms 15 to 18 still lie in a space comprised within the plan volume of the container and consequently same may be lowered, with the new orientation, even between two stacks of adjacent containers.

On course, between the lifting and lowering operations of the container, same may be moved horizontally together with the group consisting of said central body 10, said lower catching frame 40 and said spreader.

Figure 6:
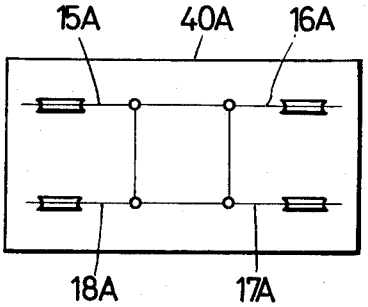

It is to be appreciated that during the container rotation from the position defined by 40A in FIGS. 1 and 6 of said lower catching frame, arms 15 and 17 diametrally opposed and not adjacent rotate rightwards, that is to the same direction as said lower frame 40. On the contrary, arms 16 and 18 rotate leftwards, that is to the contrary direction as said lower frame 40.

Figure 7:
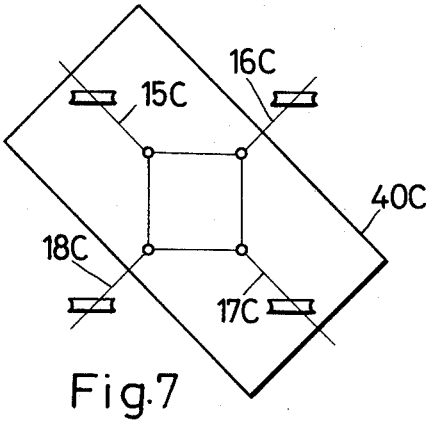
FIGS. 6 to 10 show diagrammatically the position of said orientable arms during a rotation for 180° of a container.
Figure 9:
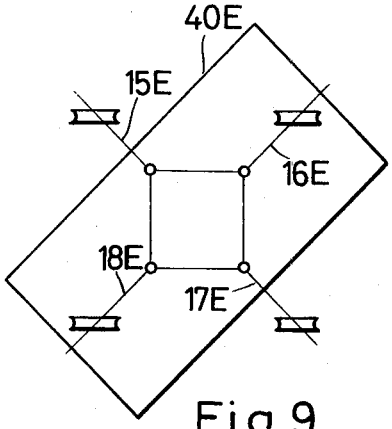

Consequently, as shown in FIGS. 1 and 7, in an intermediate position 40C of said lower catching frame 40, arms 15 and 17 will be substantially aligned to the longitudinal direction of said lower frame 40, while arms 16 and 18 will be arranged transversal to the longitudinal direction of said lower frame 40, so that to the container below, whose barycenter nearly never coincides with the geometrial center of the parallelepiped defining its volume, is always assured a sufficient stability against any listing moment caused by the decentered position of the container barycenter.

Figure 8:
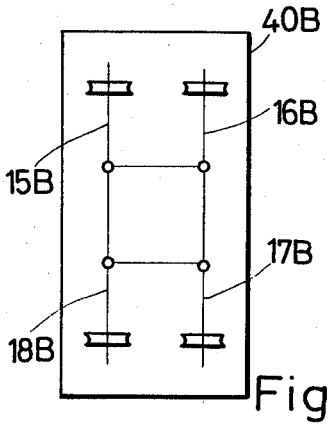
Figure 10:
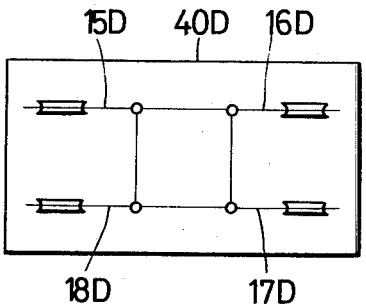

If it is desired, starting from position 40B shown in FIG. 8, to rotate said lower catching frame 40 and the container below to a position 40D shown in FIG. 10 rotated for 180° with respect to position 40A, while said lower frame 40 rotates for a further 90° rightwards, arms 15 to 18 rotate for about 90° returning to their starting position 15A–18A, as shown in FIG. 10. During said rightward rotation of said lower frame 40 from position 40B to position 40D, arms 16 to 18 will rotate rightwards to the same rotation direction as said lower frame 40, while arms 15 and 17 will rotate for 90° leftwards to the starting position 15A and 17A.

In an intermediate position 40E of said frame 40 between positions 40B and 40D, arms 16 and 18 will remain substantially aligned to the longitudinal axis of said lower frame 40 (and thus of the container), while arms 15 and 17 will be transversal to said longitudinal direction. In this case too any listing moment of said lower frame 40, said spreader and container will be avoided during the rotation of said lower frame 40.

Therefore, said lower catching frame 40 may rotate without any limit for any rotation angle in either direction and clearly for more turns. However, only in two positions of the lower frame 40 with respect to said central body 10 said arms 15 to 18 are comprised in the volume of of said lower catching frame and thus of the container. Said two positions are at 90° to each other.

Figure 4:
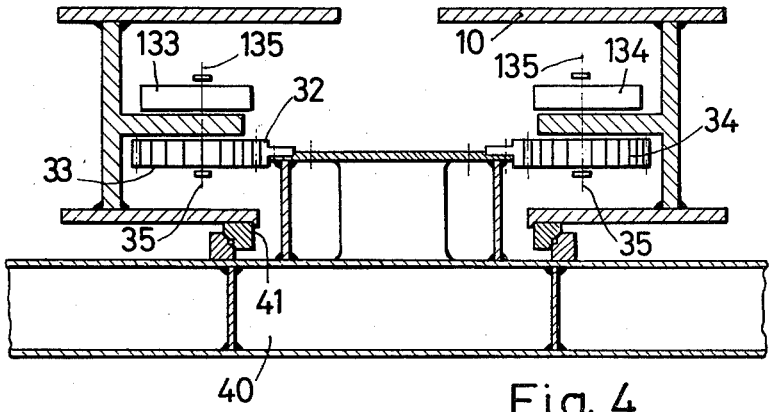
FIG. 4 is a vertical section along a line IV—IV of FIG. 1.

According to a preferred embodiment of the invention shown in FIGS. 4 and 5, in order to use the same engine 30 to rotate simultaneously said arms 15 to 18 and said lower catching frame 40, said engine 30 rotates a vertical axis toothed wheel 31. Said toothed wheel 31 engages a toothed crown 32 centered on the rotation axis of said lower catching frame 40 and integral thereto.

Said toothed crown 32 on its turn engages two toothed wheels 33 and 34 mounted in a freely turnable way on said central body 10 in a position diametrally opposed to the axis of said toothed crown 32. Therefore, said two equal toothed wheels 33 and 34 rotate at the same speed and to the same direction.

Pins 35 are mounted on the lower face of said toothed wheels 33 and 34, said pins 35, mounted in an eccentric position, control through connecting rods 37 the reciprocating motion of rockers 36 integral in rotation with shaft 20 of said arm 18 and with shaft 20 of said arm 17 respectively.

The eccentricity of said pins 35, the length of said connecting rods 37 and the length of said rockers 36, as well as the transmission ratio between said toothed crown 32 and said toothed wheels 33 and 34, are selected so as to a rotation of 90° of said lower catching frame 40 (and thus of said toothed crown 32) may correspond a rotation of about 90° of said arms 15 and 16, not only but further when said lower catching frame 40 moves from position 40A to position 40B said rockers 36 moves from a dead center to the other one of their two end positions.

In order to control in the same way as arms 17 and 18 also said arms 15 and 16, said toothed wheels 33 and 34 are integral in rotation with discs 133 and 134 on top of which are arranged pins 135 for connecting rods 137 suitable to actuate rockers 136 integral in rotation with said arms 15 and 16 respectively, through corresponding shafts 20.

It is to be understood that the invention is not limited to the examples shown. It is intended to cover all modifications and equivalents within the scope of the appended claims.

What we claim is:

1. In a device for rotating containers, the improvement comprising a central body, four orientable arms pivotally mounted on said central body to swing about parallel vertical axis relative to said central body, a pulley mounted on each of said arms for pivotal movement about a vertical axis, said pulleys receiving support ropes coming down from a carriage arranged above and sliding on the main bar of a crane, means for keeping said pulleys parallel to themselves during the orienting movement of said arms, and a lower catching frame rotatably supported by said central body for rotation about a vertical axis and connected to a spreader.

2. The rotating device according to claim 1, wherein each of said arms may be oriented between two end positions; suitable coupling means being provided for controlling the rotation of said arms to said end positions each time that said lower catching frame rotates through 90° in either direction with respect to said central body, whereby in each of said end positions the horizontal projection of each of said arms falls within the horizontal projection of the container.

3. The rotating device according to claim 2, wherein during the rotation of said lower catching frame at least two of said four arms remain substantially placed according to the longitudinal direction of said lower catching frame, while the other two arms are transversal or on opposed sides to the longitudinal direction of said lower catching frame, in order to avoid any possible listing moment of the container, in view of the factor that its barycenter may not coincide with its geometrical center.

4. The rotating device according to claim 2, wherein said four articulated arms are hinged to said central body at the corners of a square or rectangular figure, wherein the first of their end positions said arms are oriented parallel to a first reference direction and project two by two outwards from said central body, wherein further in the second of their end positions said arms are oriented parallel to a second reference direction, rotated 90° with respect to the first reference direction, whereby for passing from one to the other of said end positions each arm rotates in opposed direction to the rotation direction of the two adjacent arms; in each of said end positions said arms being aligned to the longitudinal direction of said lower catching frame.

5. The rotating devie according to claim 4, wherein in order to keep parallel to themselves the pulleys arranged at the ends of said articulated arms, said pulleys are mounted in an articulated way with respect to the corresponding arms by means of articulated parallelograms.

6. The rotating device according to claim 4, wherein said lower catching frame is integral with a toothed crown engaging a pinion actuated by an engine mounted on said central body, said toothed crown further engages a pair of equal toothed wheels mounted symmetrically and turnably on said central body; said symmetric toothed wheels being integral in rotation each with two eccentric pins which, through two connecting rods, control the reciprocating motion of corresponding rockers each integral in rotation with a corresponding orientable arm; wherein further the eccentricity of said pins, the length of said rockers and the transmission ratio between said toothed crown and said toothed wheels engaging each other are selected so that a rotation of 90° in either direction of said rockers corresponds to a rotation of 90° of said toothed crown.

* * * * *